US005127338A

United States Patent [19]

Flux

[11] Patent Number: 5,127,338

[45] Date of Patent: Jul. 7, 1992

[54] LOAD ATTACHMENT, TRAVERSING DEVICE WITH SPRING BIASED SCISSOR LINKAGE TO GRIP CABLE AND PERMIT TRAVERSAL OF CABLE HANGERS

[75] Inventor: Peter R. Flux, Calne, England

[73] Assignee: Latchways Limited, Chippenham, England

[21] Appl. No.: 534,763

[22] Filed: Jun. 8, 1990

[30] Foreign Application Priority Data

Jun. 20, 1989 [GB] United Kingdom ..... 8914169

[51] Int. Cl.[5] ..... B61B 7/00

[52] U.S. Cl. ..... 105/151; 104/87

[58] Field of Search ..... 104/87, 93, 112, 242; 105/150, 151, 153, 30, 73

[56] References Cited

U.S. PATENT DOCUMENTS

| | | | |
|---|---|---|---|
| 834,798 | 10/1906 | Haley | 104/87 |
| 878,653 | 2/1908 | Matthews et al. | 104/182 X |
| 1,809,448 | 6/1931 | Koster et al. | 104/93 X |
| 2,927,539 | 3/1960 | Baumann | 104/93 X |
| 2,953,116 | 9/1960 | Lund | 104/112 X |
| 3,498,236 | 3/1970 | Meek | 105/30 |
| 4,154,171 | 5/1979 | Garnier | 104/182 |
| 4,265,179 | 5/1981 | Tupper et al. | 104/182 |
| 4,462,316 | 7/1984 | Tupper | 105/151 |
| 4,470,354 | 9/1984 | Tupper | 104/93 |

FOREIGN PATENT DOCUMENTS

| | | | |
|---|---|---|---|
| 0198310 | 6/1958 | Austria | 104/112 |
| 934414 | 10/1955 | Fed. Rep. of Germany | 104/112 |
| 2020746 | 12/1971 | Fed. Rep. of Germany . | |
| 2045659 | 3/1972 | Fed. Rep. of Germany | 105/153 |

*Primary Examiner*—Robert J. Oberleitner
*Assistant Examiner*—S. Joseph Morano
*Attorney, Agent, or Firm*—Frishauf, Holtz, Goodman & Woodward

[57] ABSTRACT

A load attachment system comprises an elongate element secured with respect to a supporting structure and a load attachment, traversing device engaged therewith for sliding movement therealong to traverse intermediate attachment points for the elongate element without detachment therefrom. The traversing device includes a pair of rotary members which cooperate to define a channel for receiving and locating the elongate element. The rotary members are supported on mounting structure adapted to allow relative movement of the rotary member to narrow, or increase, the width of the channel. A load attachment connection is provided on the mounting structure to cause loading of the rotary members, under loads applied in directions away from the elongate element, so as to firmly maintain them in relative positions in which the channel is narrowed thereby securing the elongate element in the channel and reducing the possibility of detachment of the load from the elongate element.

9 Claims, 11 Drawing Sheets

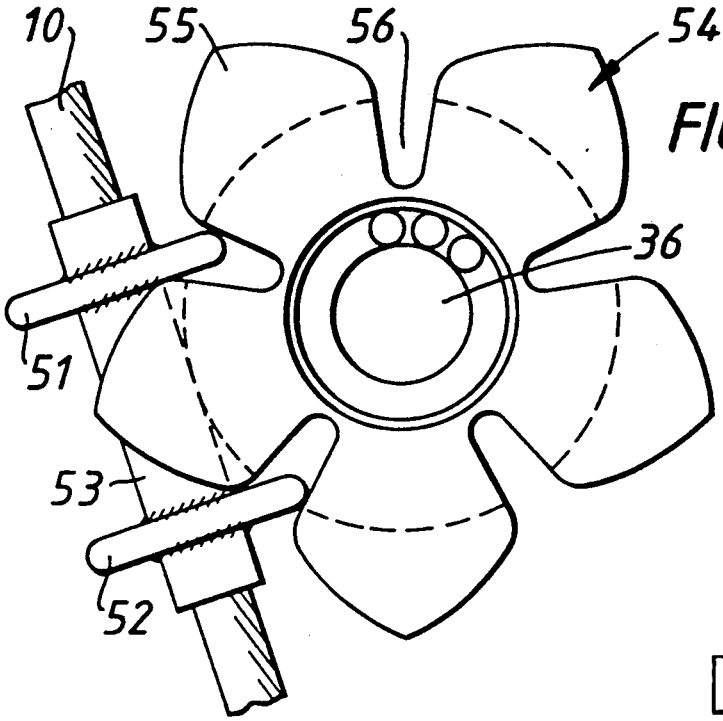
FIG. 8.
FIG. 9.
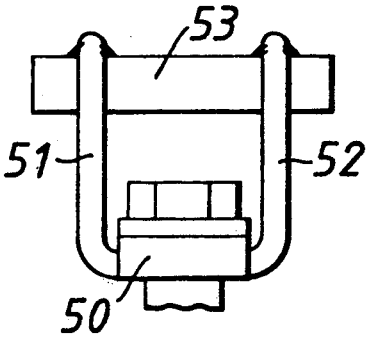
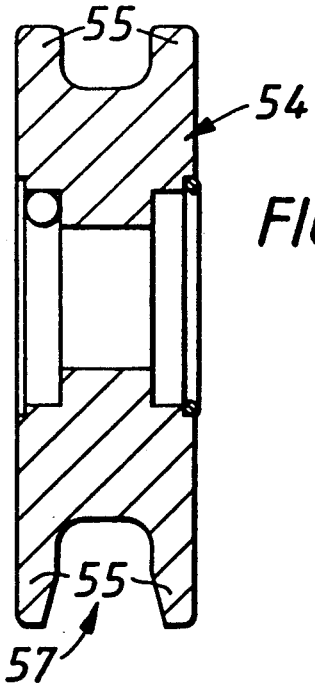
FIG. 10.

LOAD ATTACHMENT, TRAVERSING DEVICE WITH SPRING BIASED SCISSOR LINKAGE TO GRIP CABLE AND PERMIT TRAVERSAL OF CABLE HANGERS

FIELD AND BACKGROUND TO THE INVENTION

The invention provides a device for enabling a load to be moved along a path defined by an elongate guide member, freely past support or attachment points for the guide member.

A load attachment system comprising a securely fastened guide line allows personnel or equipment to move along the general path of the elongate guide line whilst being attached thereto by means of a fastener engagable with the guide line for sliding movement therealong. If the fastener is in the form of a clip, it is necessary to detach the clip from the guide line at each immediate fixed location point along the length of the guide line and then re-engage the clip with the guide line on the other side of the location point. U.S. Pat. Nos. 4,265,179; 4,470,354 and 4,462,316, the disclosures of which are included herein by reference, describe traversing devices which can be located as a sliding fastener, e.g. at the end of a safety harness lanyard, for engagement with a guide line enabling passage past the intermediate location points of the guide line without detachment of the fastener from the guide line.

The object of the invention is to provide another form of load attachment, traversing device for use with an elongate element secured at positions spaced along its length with respect to a fixed structure. Such a system provides an alternative structure to those of the above-described prior art constructions which in some embodiments provide technical advantages, such as reduction of manufacturing precision required for some parts of the apparatus.

DE-OS-2,020,746 discloses a cable location station having mounted thereon spring-loaded rollers for locating a moving cable whilst permitting the passage of cable grips connecting the cable to a movable trolley structure which is constrained to move along a pair of fixed rails. This specification is not concerned with a load attachment device movable along and located solely by a fixed elongate track element such that, under load, the attachment device remains securely fastened to the track element whilst being able to traverse intermediate support positions of the track element.

U.S. Pat. No. 4,154,171 discloses an overhead cable transport installation utilizing a pair of pulley wheels which may separate against the action of a spring to permit the passage of cable grips therebetween. The cable is not entrapped by pulley wheels to prevent disengagement therefrom. Once again this specification is not concerned with a load-attachment device which is movable along and located solely by a fixed elongate track element such that, under load, the attachment device remains positively engaged with the track element which is trapped in a channel through the device.

U.S. Pat. No. 878,653 discloses a trolley pulley in which two rollers mounted above the support cable are spring-loaded to be movable upwardly to pass a cable grip or similar obstruction on the cable. However, under heaving loading the cooperating pulleys located below and above the cable tend to separate thereby allowing detachment from the cable.

SUMMARY OF THE INVENTION

The invention provides a load attachment system comprising:

an elongate element secured with respect to a supporting structure at least at one position along its length by securing means cooperating with the elongate element and including at one attachment portion projecting laterally of the elongate element; and, a traversing device engagable with the elongate element for movement therealong and comprising:

at least one pair of rotary members which cooperate with one another to define a channel through the traversing device for receiving and locating the elongate element, mounting means supporting the rotary members for relative movement to narrow the transverse width of said channel, and for relative movement to increase the transverse width of said channel to accommodate parts of said securing means between the rotary member; and, load attachment means associated with said mounting means and adapted, under loading applied thereto in directions away from the elongate element, to apply a force to said rotary members acting to firmly maintain them in relative positions in which said channel is narrowed as aforesaid thereby securing said elongate element in said channel.

Limiting means may be provided for limiting said relative movement of the rotary members away from one another to accommodate parts of said securing means between the rotary members without permitting disengagement of said elongate element from said channel. Said limiting means may be releasable to allow an engagement or disengagement of the traversing device with or from the elongate element.

Said elongate element may be in the form of a rigid track element or include a rigid track element section, particularly but not exclusively where it is necessary to negotiate a corner or other curved portion, and said laterally projecting support element could be formed integrally with said track element or track element section. Said elongate element may be in the form of a flexible line, e.g. a wire element, which may also cooperate with rigid track elements or rigid track element sections as aforesaid.

Said rotary members may be in the form of cooperating roller elements having annular grooves in their peripheries, said channel being defined by cooperating portions of said grooves at a position where the rollers engage one another in one extreme position of their relative movement.

In other embodiments, a plurality of pairs of said cooperating grooved roller may be provided on said mounting means.

In further embodiments, a further grooved roller may be provided on said mounting means having its axis disposed perpendicular to the axes of said cooperating rollers for running on top of a generally horizontally disposed elongate element, said further roller comprising a pair of separate portions which are mounted on said mounting means to be movable away from one another when said cooperating rollers are moved relative to one another to permit the device to traverse an intermediate support point of the elongate element.

In other embodiments said rotary members may be in the form of wheels having radially projecting portions having arcuate grooves in their outer peripheries for defining said channel and being separated by radial recesses extend inwardly from the peripheries of the wheels for receiving and passing laterally projecting support elements for the elongate member when traversing an intermediate support point thereof. In such embodiments a pair of spaced apart wheels may be provided for location on one side of the elongate element, a further wheel being positioned between said pair of wheels, in the longitudinal direction of the elongate element, and on the opposite side of the elongate element, said mounting means being adapted to permit movement of said pair of wheels relative to said further wheel when traversing an intermediate support point of the elongate element.

Said mounting means may be resiliently biased in a direction to move said rotary members so as to reduce the transverse width of said channel.

Said mounting means may comprise an axially expandable and contractable link mechanism, including a pair of link arms which cross one another and are pivotally connected at their point of intersection, one pair of corresponding ends of the link arms carrying a respective one of said pair of rotary members with the other pair of corresponding ends of the link arms being pivotally connected to a load attachment structure of the device.

In other arrangements according to the invention, said mounting means may provide a pair of pivotally mounted supports each carrying a respective one of said pair of rotary members.

The invention also provides a load attachment system comprising an elongate element secured with respect to a fixed structure at least at one position along its length by securing means cooperating with the elongate element and including at least one portion projecting laterally of the elongate element, in combination with a traversing device which comprises at least a pair of rotary members supported by mounting means to cooperate with one another to define a channel through the device for receiving and locating the elongate element, said mounting means being adapted to allow at least a limited amount of relative movement between the rotary members so as to increase the transverse width of said channel to allow the device to traverse said intermediate support points of the elongate element without permitting detachment of the device from the elongate element by accommodating said laterally projecting portion of said securing means.

Said elongate element may be provided at said at least one position with a laterally projecting planar element for fixing with respect to said fixed structure.

BRIEF DESCRIPTION OF THE DRAWINGS

Embodiments of the invention will now be described by way of example and with reference to the accompanying drawings in which:

FIG. 8 is a diagrammatic illustration of an alternative intermediate wire guide and an alternative rotary wheel assembly for use with the device of FIGS. 3 and 4, illustrating how the wheel cooperates with the wire guide;

FIG. 9 is an end view of the wire guide of FIG. 8;

FIG. 10 is a diagrammatic cross-section through the rotary wheel illustrated in FIG. 8;

DETAILED DESCRIPTION OF SPECIFIC EMBODIMENTS

Figure 4:
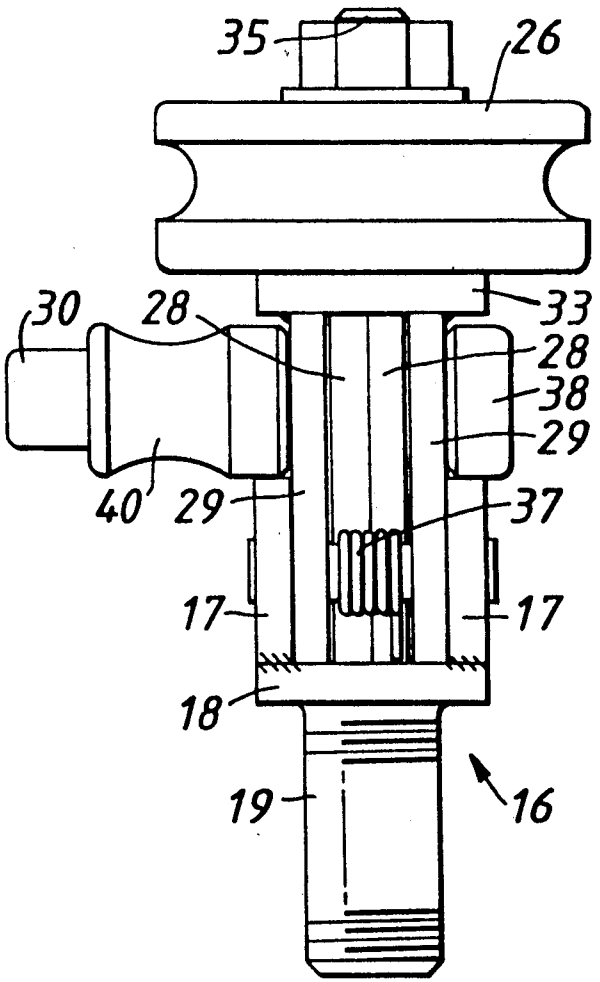
FIG. 4 is an end view of the device of FIG. 3.
Figure 3:
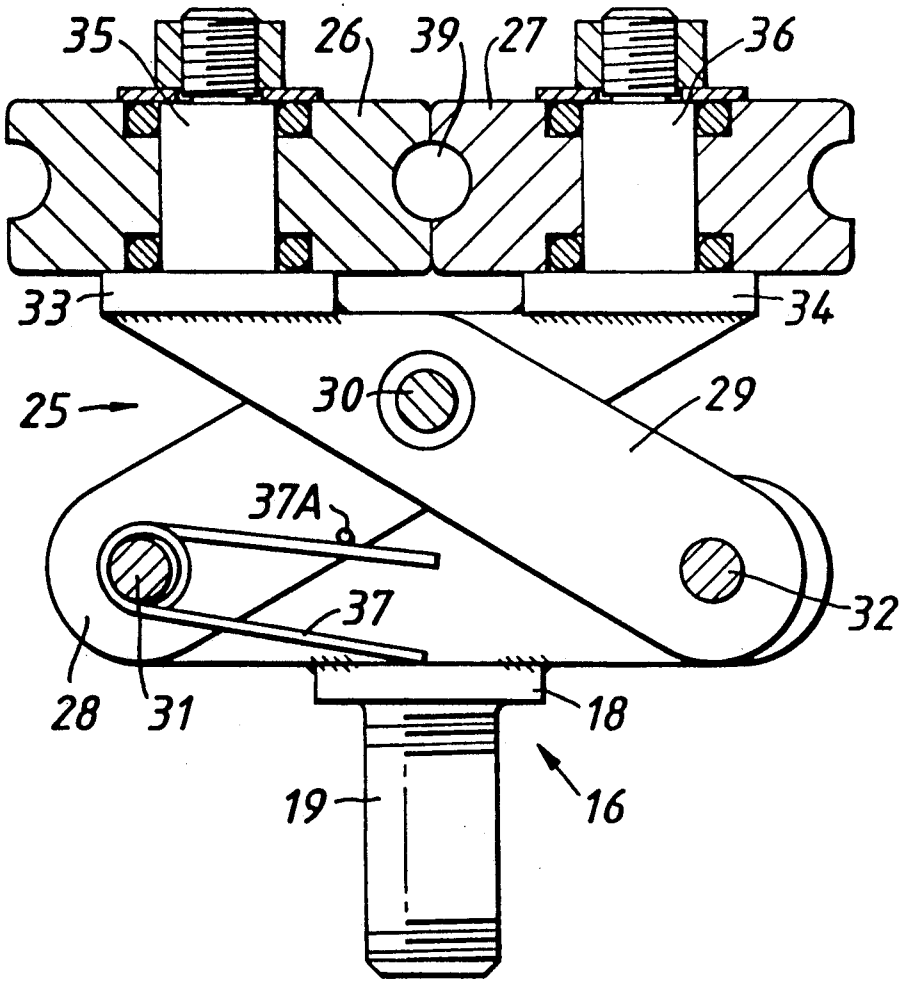
FIG. 3 is a diagrammatic side view partly in cross section of a load attachment device embodying the invention, with a side plate thereof removed.
Figure 5:
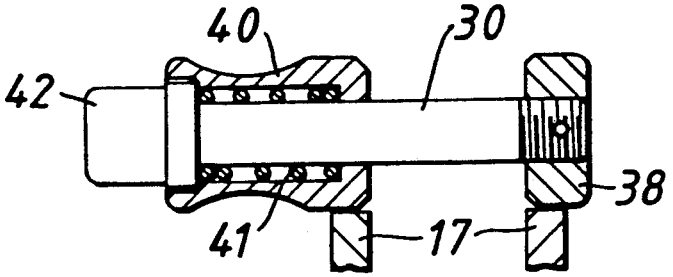
FIG. 5 is a diagrammatic detail of an attachment control mechanism of the device of FIGS. 3 and 4.

FIGS. 3 to 5 illustrate a load attachment device which is adapted to engage a safety wire secured with respect to a fixed structure, for example the outside face of a building, to enable a load to be fixed with respect to the safety wire for longitudinal movement along the safety wire such that intermediate attachment points of the wire can be traversed by the load attachment device without detachment thereof from the safety wire.

Figure 1:
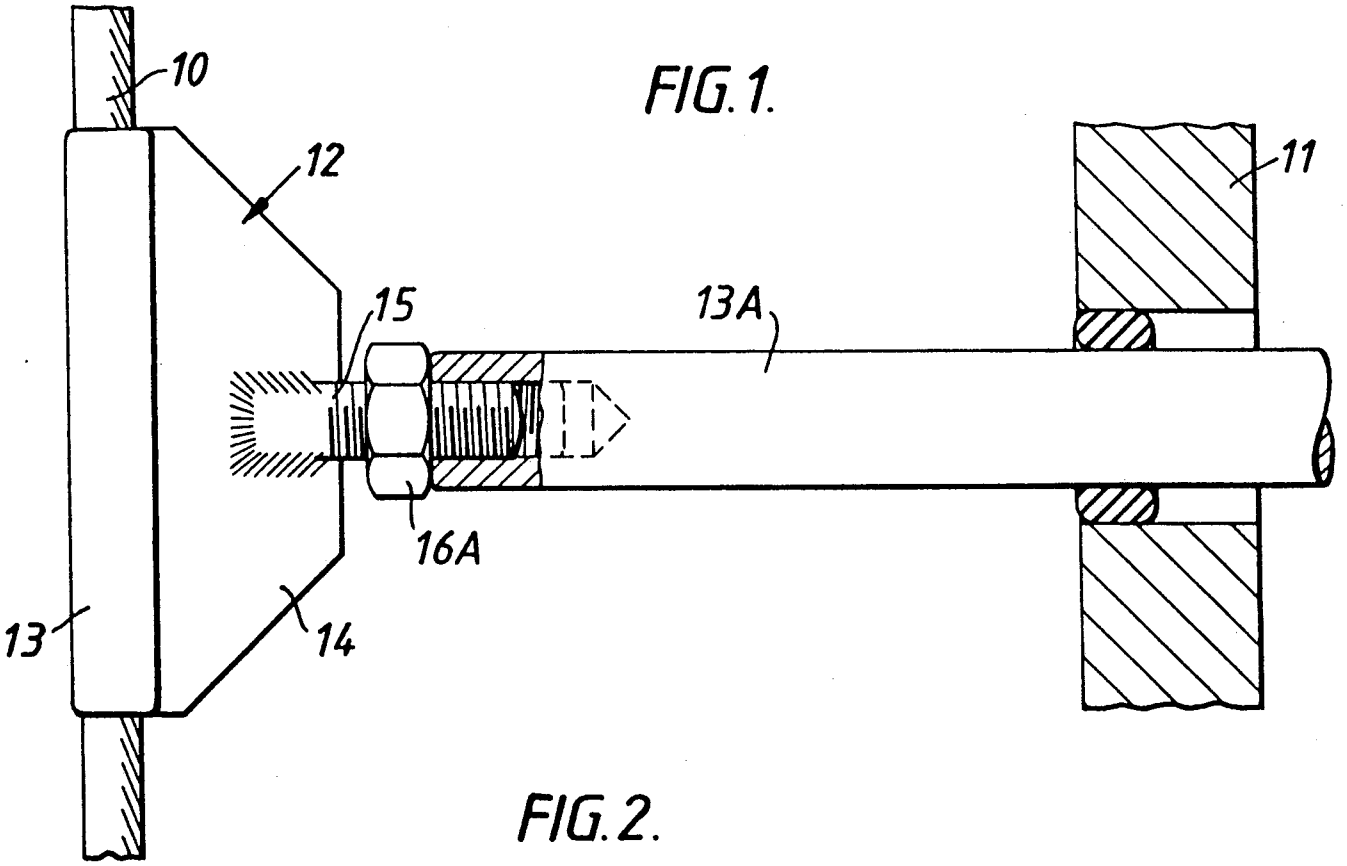
FIG. 1 is a diagrammatic cross-section of an intermediate fixed guide for a safety wire.
Figure 2:
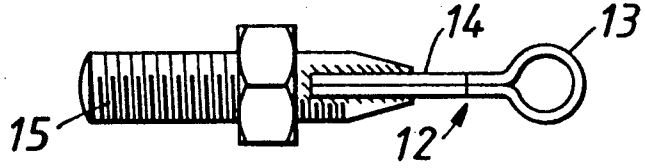
FIG. 2 is a plan view of the wire guide of FIG. 1.

Referring to FIGS. 1 and 2, a safety wire (10) is secured with respect to a building wall (11) at intermediate points along the wire by the use of wire guides (12) which are secured to the free ends of rods (13A) embedded in the wall (11) and having end portions projecting therefrom. Each wire guide (12) comprises a metal sheet which is folded centrally and fabricated to define a tubular sleeve portion (13) with the flat edge portions of the sheet being superimposed to define a laterally projecting fin (14). A threaded stud (15) is slotted at one end to receive the fin portion (14) of the wire guide which is welded to the stud (15). The free end of the stud (15) is received in a threaded bore in the projecting end of a rod (13A) and secured therein by a lock nut (16A). The safety wire (10) passes through the tubular section (13) of the wire guide.

For locating vertically moving loads with respect to the building structure, the safety wire (10) would be mounted to extend in a vertical direction. A typical application would be for locating vertically moving cradles used, for example, by window cleaners. FIGS. 3 to 5 illustrate a load attachment device for securing to loads, such as cradles, which can be engaged with the safety wire (10) for free movement therealong whilst enabling the load attachment device to traverse the intermediate wire guide support devices (12) without detachment of the load attachment devices from the safety wire (10).

Figure 6:
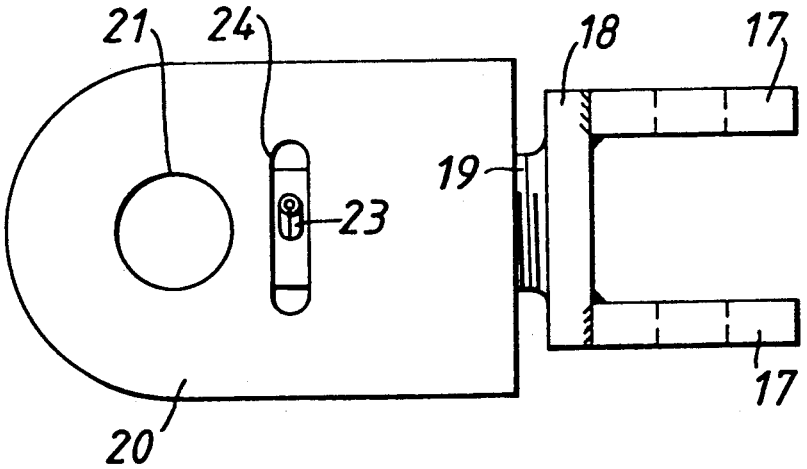
FIG. 6 is a side view of an attachment bracket for the device of FIGS. 3 and 4.
Figure 7:
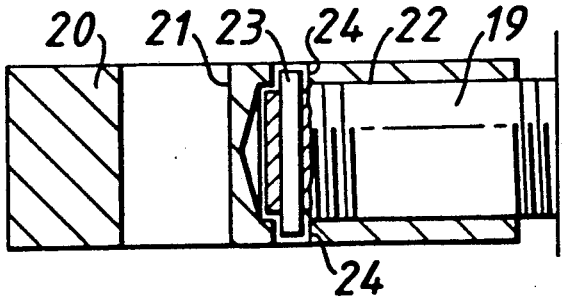
FIG. 7 is a cross-sectional detail of the bracket of FIG. 6.

Referring to FIGS. 3 and 4, the load attachment device comprises a yoke-like body part (16) comprising a pair of spaced apart elongate side plates (17) upstanding from a base plate (18) and a threaded attachment spigot (19) depending from the lower surface of the base plate (18). FIGS. 6 and 7 illustrate an attachment bracket for connecting the load attachment device to a load such as a workman's cradle, to allow a limited amount of pivotal movement with respect thereto about mutually perpendicular axes. The attachment bracket (20) has a transverse aperture (21) for receiving a pivot pin connector to the cradle. The cylindrical spigot (19) of the body part of the load attachment device is received in a blind bore (22) in the bracket. The spigot (19) is located in the bore (22) by a pin (23) which passes through an end portion of the spigot (19) and projects from each side thereof into a pair of diametrically opposed slots (24) in the bracket (20) allowing a limited amount of relative rotation between the spigot (19) in the cylindrical bore (22) in the bracket.

The load attachment device further comprises a scissor-like mechanism (25) for mounting a pair of cooperating grooved rollers (26,27) on the body part (16). The mechanism (25) comprises two pairs of link arms (28,29) which are arranged to cross one another and are pivotally connected at their point of crossing by a pivot pin (30). The lower ends of the link arms (28,29) which are received between the side plates (17) of the body part (16), are pivotally connected to those side plates (17) by respective pins (31,32). Discs (33,34) are secured to the upper ends of the link arms (28,29) respectively and each disc (33,34) is provided with an upstanding stub axle (35,36). The grooved wheels (26,27) are mounted on the stub axles (35,36) respectively by means of ball bearings. A torsion spring (37) is provided to act between a peg (37A) on the link arm (28) and the base portion (18) of the body part (16) so as to bias the scissor mechanism (25) in a direction such that the peripheries of the rollers (26 and 27) engage one another as illustrated in FIG. 3. In this position, at their points of engagement, the semi-circular grooves in the rollers (26,27) define a circular passage (39) which receives the safety wire (10) whereby the load attachment device can freely move along the safety wire (10) by rotation of the rollers (26 and 27) whilst the load attachment device is located laterally with respect to the safety wire by the continuous engagement of the rollers (26,27) under the influence of torsion spring (37) and the load applied in use to the scissor mechanism (25) tending to maintain the rollers (26,27) in engagement. The greater the loading, the greater the force pressing the rollers together.

When the load attachment device encounters an intermediate wire guide (12) of the safety wire (10), it is capable of traversing such device without risk of detachment of the device from the safety wire location system. Such traversing action is possible by a limited movement of the rollers (26,27) away from one another to allow the lateral fin (14) of the wire guide to pass between the rollers. This movement is achieved by vertical contraction of the scissor-type mechanism (25) against the action of torsion spring (37). However the amount of such movement is constrained by engagement of portions associated with the pivot pin (30) of the scissor mechanism with the upper faces of the side plate (17) of the body part (16), as will be explained in more detail below. The separation of the rollers (26,27) is therefore controlled such that it is sufficient to pass the fin (12) when required but is insufficient to allow the tubular sleeve (13) to become disengaged from the cooperating grooves of the rollers (26 and 27). In this way, each intermediate wire guide (12) can be traversed without risk of complete detachment of the load attachment device from the safety wire system.

Referring to FIG. 5, the pivot pin (30) of the scissor mechanism (25) has secured thereto at one end an end cap (38). A control sleeve (40) is slidably mounted on the opposite end of the pin (30) which projects from the opposite side of the scissor mechanism (25). The control sleeve (40) is biased towards the end cap (38) by a compression spring (41) located within the sleeve (40) and which acts against a shoulder provided by a head portion (42) at the projecting end of the pin (30). In order to allow the load attachment device to be engaged with the safety wire (10), the head portion (42) of the pin is pressed towards the scissor mechanism (25) to disengage the end cap (38) from the upper edge of the cooperating side plate (17). The control sleeve (40) is slid in the opposite direction to disengage it from the opposite side plate (17) thereby allowing the scissor mechanism (25) to be further contracted in the vertical direction which causes the rollers (26,27) to be moved further apart to a degree sufficient to allow an initial engagement of the safety wire (10) into the space (39) defined between the grooves of the rollers (26,27). After such initial engagement with the safety wire (10), the scissor mechanism is released so that the rollers (26,27) are moved towards one another under the action of torsion spring (37). Furthermore release of the control sleeve (40) and the head portion (42) of the pin (30) results in movement of the control sleeve (40) and the cap portion (38) towards one another under the action of compression spring (41) to the condition shown in FIGS. 4 and 5. In such condition, the control sleeve and the end cap (38) are positioned to engage the upper edges of the side plates (17) thereby to limit the movement of the scissor mechanism such that the rollers (26,27) can then only separate to a degree sufficient to accommodate the fin portion (14) of an intermediate wire guide (12) during a traversing operation but cannot separate sufficiently to allow disengagement of the load attachment device from the safety wire system.

It will be appreciated that instead of using a safety wire (10) fitted with intermediate tubular support hangers (12) it is possible to use a rigid cylindrical or tubular track having integrally formed laterally projecting attachment fins. In some systems the elongate element may comprise safety wire sections which cooperate with rigid cylindrical or tubular track sections.

Referring to FIGS. 8 to 10, there is shown a different form of intermediate wire guide for the safety wire (10). The intermediate wire guide comprises a base plate (50) which is bolted to a fixed structure. A pair of metal loops (51,52) are fixed at their free ends to opposite edges of the plate (50). A tubular sleeve (53) extends between and within the upwardly projecting loop elements (51,52) and is welded thereto to be held in a fixed position above the base plate (50). The safety wire (10) extends through the tubular sleeve (30) and is thereby located with respect to the fixed structure to which the base plate (50) is bolted. A number of such intermediate wire guides are provided at spaced locations along the length of the safety wire. In order to traverse intermediate wire guides as shown in FIGS. 8 and 9, a modified form of load attachment device is used and this will now be described with reference to FIGS. 8, 10 and 11. The basic structure of the load attachment device is similar to that shown in FIGS. 3 to 5 except that the rollers (26,27) of that embodiment are not used. A rocking plate (60) is pivotally connected to stub axle (35) of the scissor mechanism (25). This rocking plate has a pair of stub axles (61,62) projecting therefrom at opposite ends of the rocking plate (60). Three rotary star wheels (54) are mounted on the stub axles (61,62) of the rocking plates (60) and (36) of the scissor mechanism, respectively. Each star wheel (54) is formed with, in this embodiment, five equi-angularly spaced projecting petals (55) with similar peripheral grooves (56) defined therebetween. The circumferential periphery of each star wheel is formed with an annular series of grooves (57) to provide an arcuate channel in each petal (55) for receiving the safety wire (10) and also the tubular guide (53) of an intermediate wire guide, during a traversing operation thereof as illustrated in FIG. 8. The petals (55) are shaped such that the loop elements (51,52) of the wire guide are received in a pair of adjacent grooves (56) during a traversing operation when the star wheels (54) rotate on their respective stub axles. When an intermediate wire guide is to be traversed, a first star wheel mounted at the leading end of rocking plate (60) in the direction of movement of the load attachment device, receives the loop elements (51,52) in a pair of adjacent grooves (56) whereupon the star wheel (54) rotates about its axis to pass the wire guide therethrough whilst locating the tubular section (53) of the wire guide in an arcuate groove (57) in the periphery of the respective petal (54). The wire guide is then similarly traversed by the star wheel mounted on stub axle (36) and then by the third star wheel mounted on the other stub axle on plate (60). The required separation between the pair of star wheels on one side of the safety wire (10) and the single star wheel on the opposite side of the safety wire, in order to pass the tubular section (53) of the intermediate wire guide and the loop elements (51,52), is achieved as with the previous embodiment by the permitted limited vertical contraction of the scissor mechanism (25) against the action of torsion spring (37).

Figure 11:
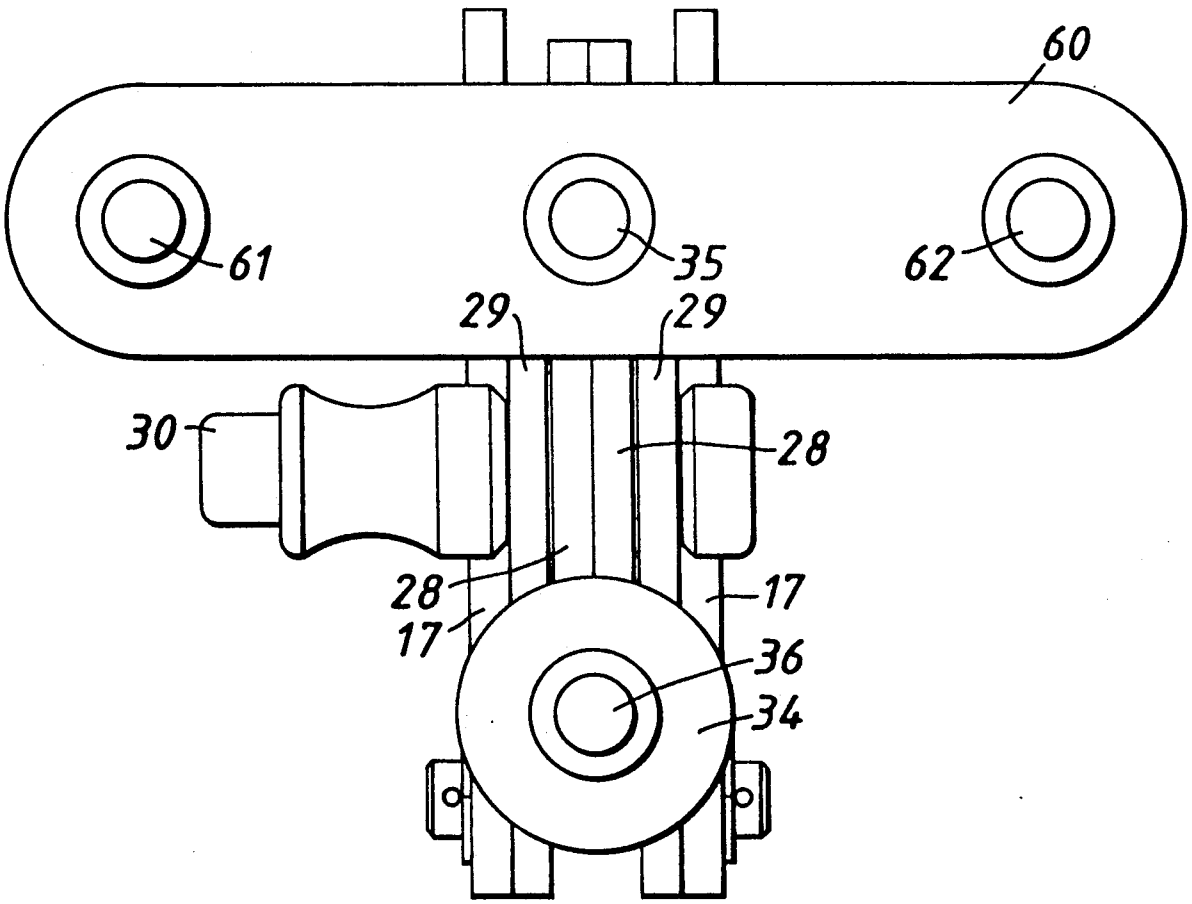
FIG. 11 is a front view of another embodiment of a load attachment device which is a modified version of the device shown in FIGS. 3 and 4.

In another possible embodiment, the upper stub-axle (35) in FIG. 11 is omitted and the plate (60) is welded directly to the disc (33) (see FIG. 3) of the scissor mechanism (25).

Figure 12:
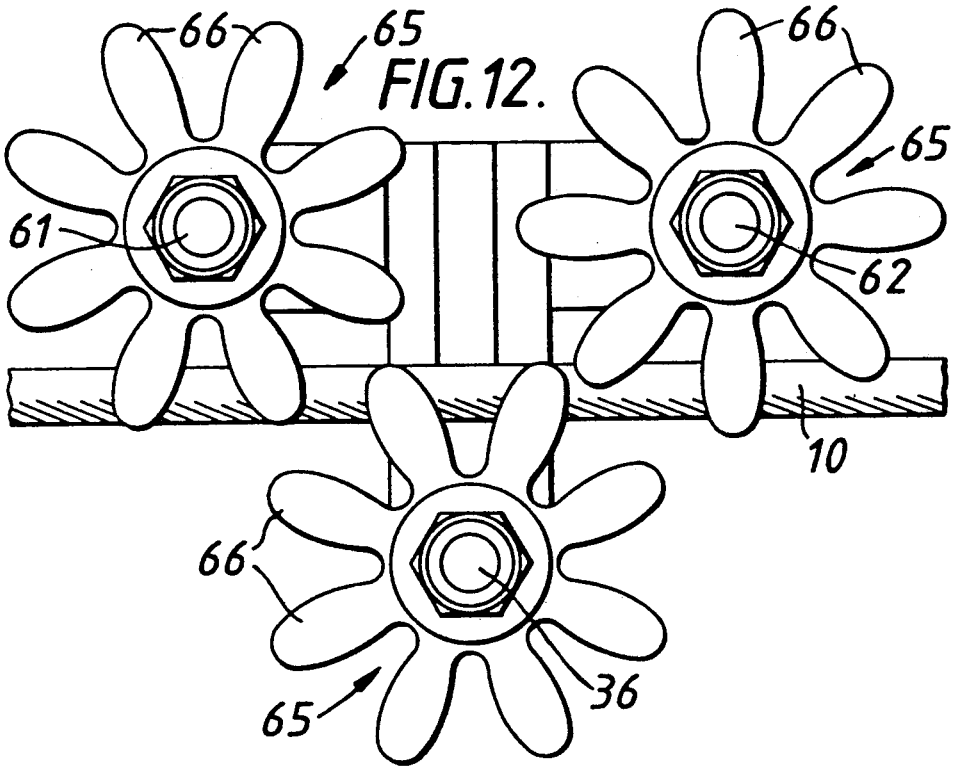
FIG. 12 is a diagrammatic front view of the device of FIG. 11 having three rotary wheels mounted thereon.
Figure 13:
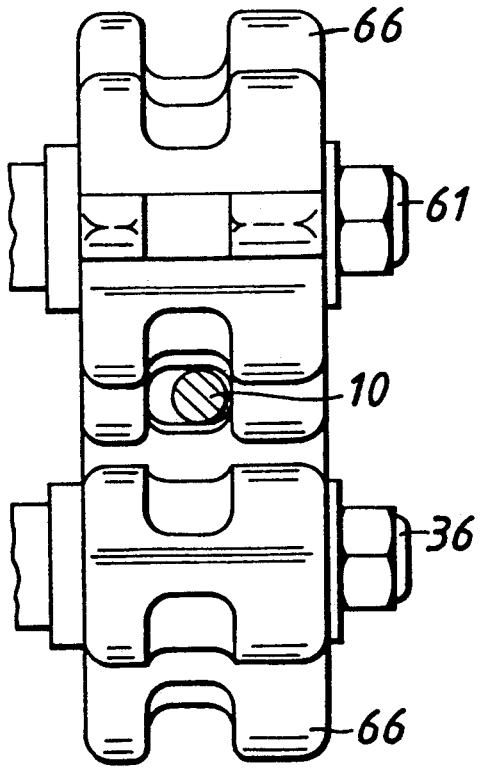
FIG. 13 is a side view of the load attachment device of FIG. 12.

FIGS. 12 and 13 show an embodiment similar to that of FIGS. 8, 10 and 11 but using star wheels (65) having eight petals (66).

Figure 15:
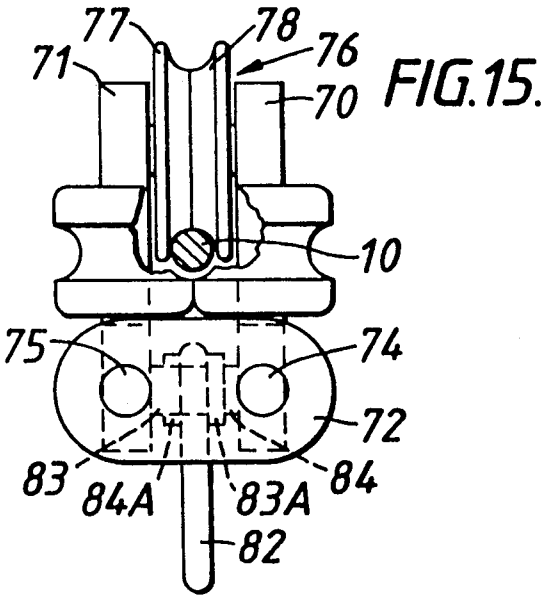
FIG. 15 is an end view of the device of FIG. 14.
Figure 14:
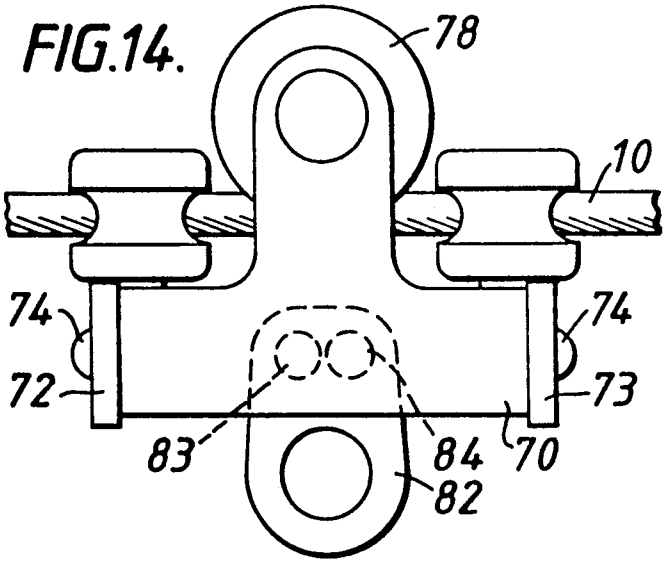
FIG. 14 is a diagrammatic front view of a further embodiment of a load attachment device according to the invention.
Figure 16:
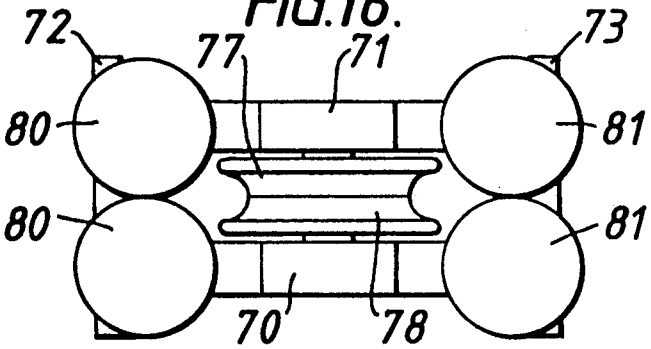
FIG. 16 is a top plan view of the device of FIG. 14.

FIGS. 14 to 16 illustrate a further embodiment of a load attachment device for use with a safety wire system as illustrated in FIGS. 1 and 2. The load attachment device comprises a pair of spaced apart side support plates (70,71) which are pivotally mounted between a pair of end plates (72,73) by a respective pair of connection studs (74,75). Each side plate (70,71) has a central upstanding portion with a split grooved roller (76) rotatably mounted between such portions. The roller (76) is split centrally into two portions (77 and 78), each of which is rotatably mounted on a respective side plate (71,70). The load attachment device is engaged with the safety wire (10) with the split roller (76) running on top of the safety wire which is received in its grooved periphery as illustrated in FIG. 15. The load attachment device has a further two pairs of cooperating grooved rollers (80 and 81) at respective opposite ends thereof. One roller of each pair (80,81) is mounted on a respective one of the side plates (70,71). The safety wire (10) is located between the cooperating rollers (80,81) in the grooved peripheries thereof.

A load attachment hanger (82) extends between the side plates (70,71) at a position below the split roller (76). Location pegs (83,84) project inwardly from respective side plates (70,71) through corresponding apertures in an upper portion of the load hanger (82) and have head portions or flanges (83A, 84A) at their free ends so as to limit the pivotal movement of the side plates (70,71) away from one another. In normal operation, along the safety wire (10) when a load is applied to the load hanger (82), the side plates (70 and 71) are urged towards one another to maintain the sections (77,78) of the split pulley (76) in engagement with one another as illustrated in FIG. 15. When the load attachment device encounters a wire guide as illustrated in FIG. 1, engagement of the leading set of rollers (80 or 81) with the fin portion (14) of the wire guide causes the side plates (70 and 71) to pivot away from one another by the restricted amount mentioned above to enable the pairs of rollers (80,81) and also the two separate portions (77,78) of the split pulley (76) to separate just sufficiently to receive the fin (14) but not sufficiently to allow passage of the tubular sleeve (13) so that disengagement from the safety wire system does not take place during such a traversing operation.

Figure 17:
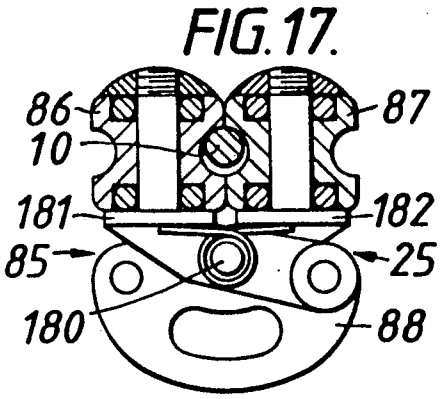
FIG. 17 is a diagrammatic side view partly in cross-section of a yet further embodiment of a load attachment according to the invention.

FIG. 17 shows a further embodiment of a load attachment device according to the invention which is similar to the device shown in FIGS. 3 and 4. The scissor-type link arm mechanism (85), which carries at its upper end the cooperating groove rollers (86,87), is mounted on a metal plate (88) having an arcuate slot therein to receive a ring-type connector or similar annular end clip element of a load attachment for a suspended load. A torsion spring encircles the central pivot pin (180) of the scissor mechanism (25) with its ends acting on the respective undersides of the stub axle support disc (181, 182) to urge the rollers into engagement.

Figure 18:
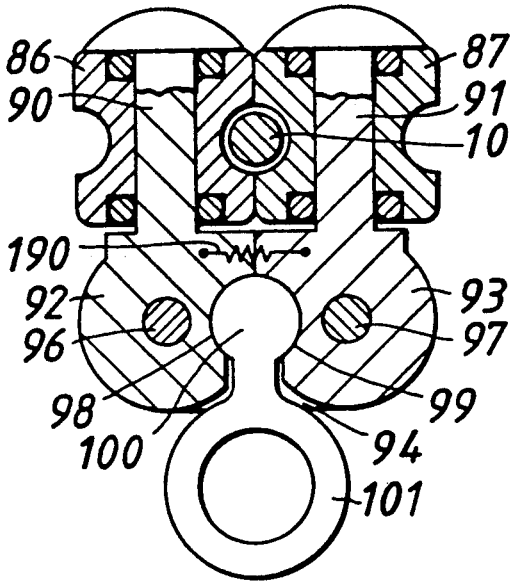
FIG. 18 is a diagrammatic vertical section through a further embodiment of a load attachment device according to the invention.
Figure 19:
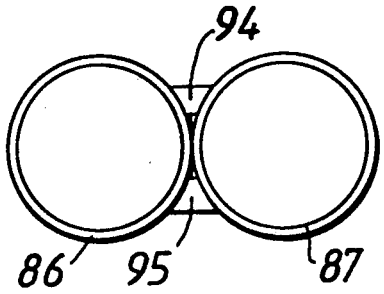
FIG. 19 is a top plan view of the device of FIG. 18.

FIGS. 18 and 19 illustrate a modified version of the load carrying bogey unit shown in FIG. 17. The grooved rollers (86,87) are mounted on stub axles (90,91) which are formed integrally at their lower ends with disc mounting portions (92,93) pivotally mounted between a pair of side plates (94,95) on transverse pins (96,97) extending between the side plates. Part circular seating surfaces (98,99) are formed in opposed edges of the disc portions (92,93) to receive a part circular projection (100) provided at the upper end of a load connector plate (101). This arrangement allows the rollers (86,87) to separate by rotation of the disc members (82,83) to allow passage of the fin portion (14) of an intermediate wire guide when encountered by the load attachment device as it moves along the safety wire (10). The disc members (92,93) are spring loaded towards one another by tension spring (190) to maintain the rollers (86 and 87) in contact with one another. The application of a load to connector plate (101) applies a force urging the rollers (90,91) into engagement with each other.

Figure 20:
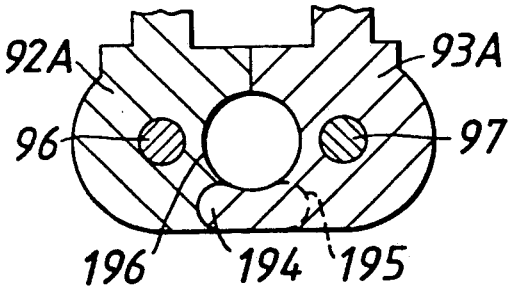
FIG. 20 illustrates an alternative load connector means for a device of the type shown in FIG. 18.

FIG. 20 illustrates a modified version of the load attachment device shown in FIGS. 18 and 19. In this embodiment, the disc parts (92A and 93A) are formed with overlapping hook-like projections (194,195) to define a generally circular aperture (196) between those parts. The disc parts (92A,93A) are freely rotatable about mounting pins (96,97) to allow separation of the rollers (86,87) to a sufficient degree to pass the safety wire (10) thereby enabling the device to be initially clipped on to the safety wire. Once the device is located on the safety wire, a suitably dimensioned load attachment clip can be engaged in the aperture (196) so as to restrict contraction of this aperture by pivotal movement of the disc parts (92A, 93A) so that separation of the grooved rollers (86,87) is restricted thereafter to an amount sufficient only to pass a fin portion (14) of a wire guide but not sufficient to pass the safety wire (10) or tubular sleeve (13) of the wire guide thereby preventing detachment of the load attachment device from the safety wire system once the clip is in place in the aperture (106).

Figure 21:
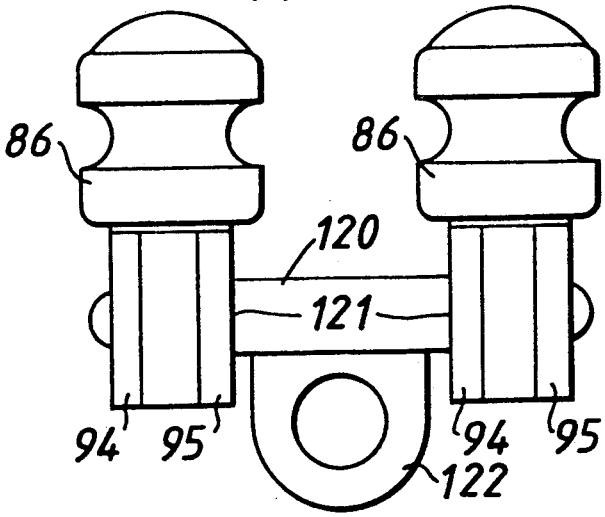
FIG. 21 is a diagrammatic end illustration of an assembly comprising a pair of load attachment devices of the type shown in FIG. 20.

FIG. 21 shows a pair of load attachment devices of the types described above in relation to FIGS. 18 and 19, connected in tandem to provide a bogey system for a suspended load having improved stability, particularly when negotiating corner sections of a safety system. The unit is provided with a pair of common axles (120) replacing axles (96,97) of the original devices, the axles (120) being stepped at (121) to maintain a rigid spaced arrangement of the two devices. Furthermore the load connector plates (101) of the devices are omitted and replaced by a common cylindrical shaft which passes between the cooperating part-circular seating surfaces (98,99) of the disc portions (92,93) of the two devices, also providing a rigid connector piece reinforcing the secure tandem arrangement of the two devices. An apertured load connector flange (122) is provided to depend downwardly from that common shaft.

Figure 22B:
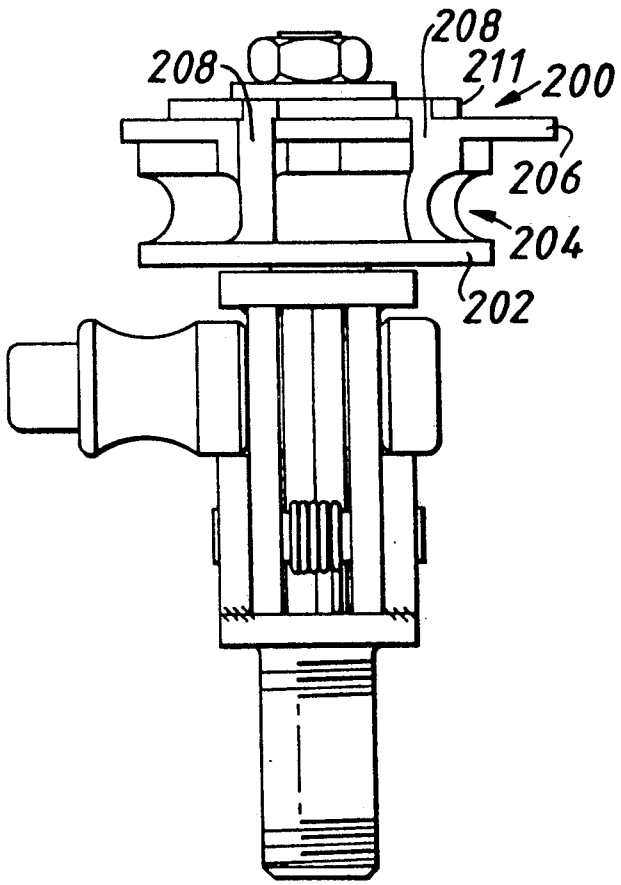
FIGS. 22A and 22B are, respectively, views similar to those of FIGS. 3 and 4 showing a further modified version of that embodiment.
Figure 22A:
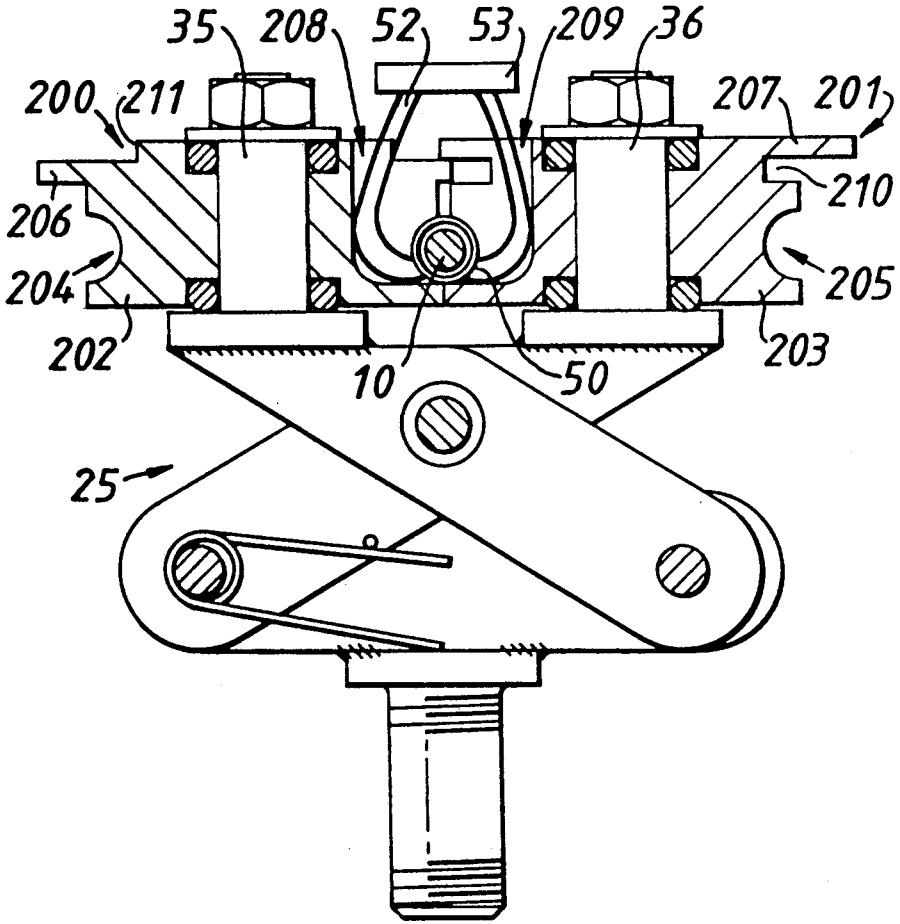
Figure 23:
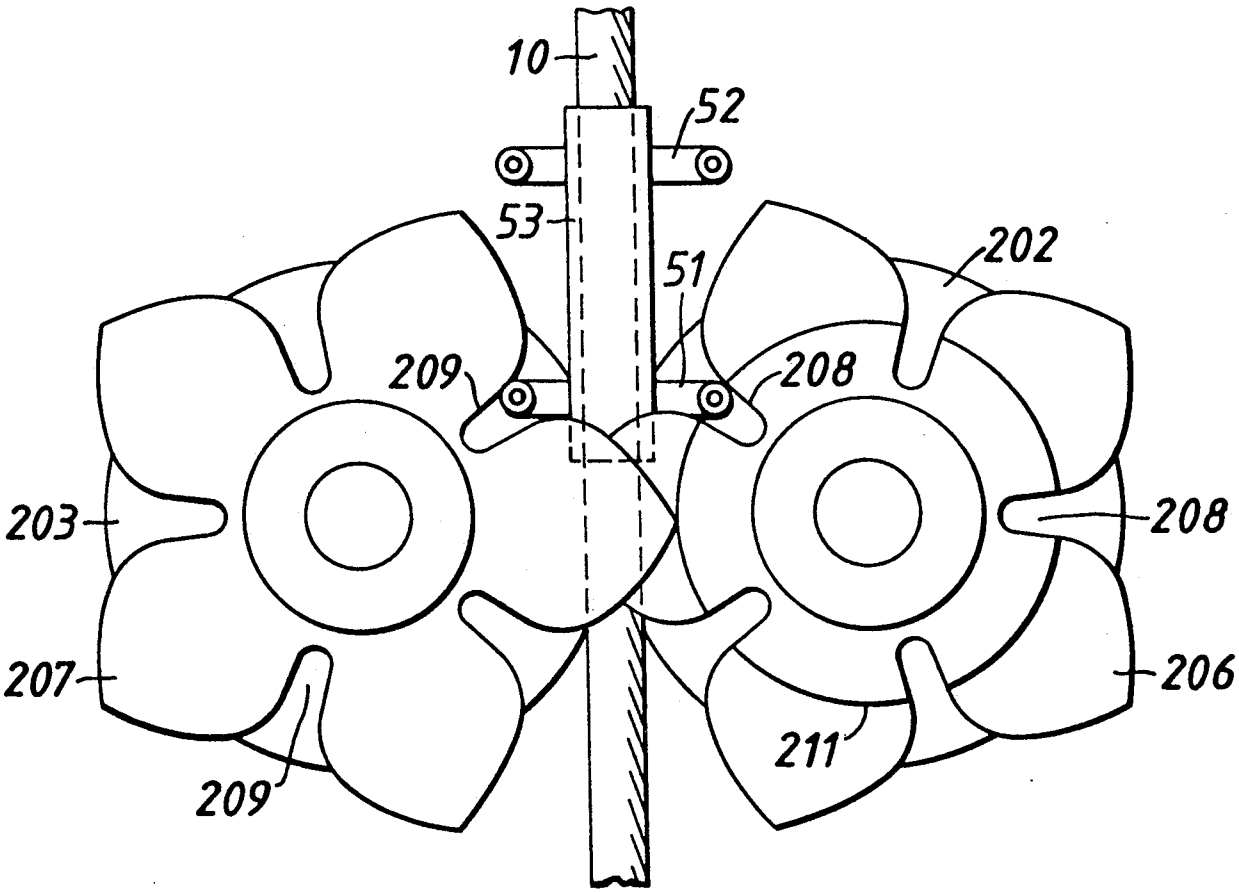
FIG. 23 is a diagrammatic plan view of the device of FIG. 22.
Figure 24:
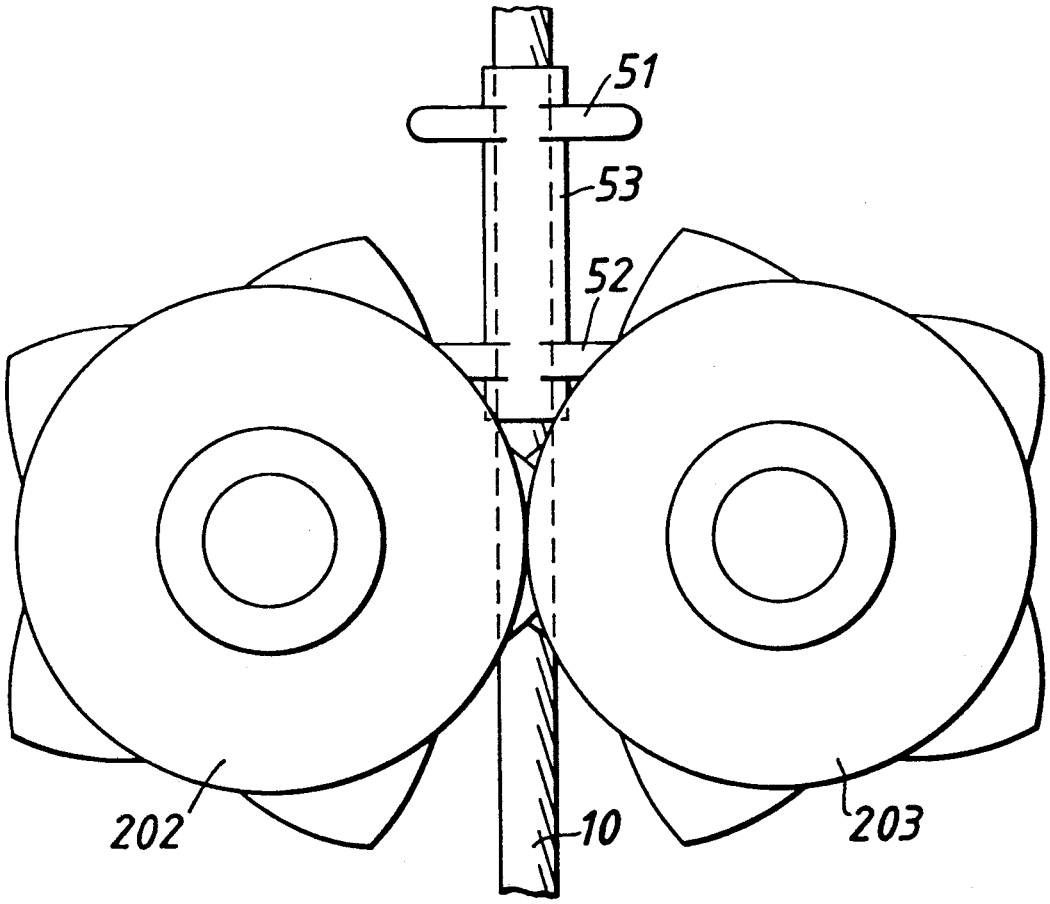
FIG. 24 is a diagrammatic underplan view of the star-wheel arrangement of the device of FIG. 22.

FIGS. 22 to 24 illustrate another type of device for traversing intermediate wire guides of the type shown in FIGS. 8 and 9. The basic structure of the load attachment device is similar to that shown in FIGS. 3 to 5 except that the rollers (26,27) of that embodiment are replaced by five-petal star wheels (200,201). Each star wheel (200,201) essentially comprises an annular hub mounted on a respective stub axle (35,36). The lower ends of the hubs of the wheels (200,201) comprise disc portions (202,203) which engage one another. Above the disc portions (202,203) each wheel has a central annular section corresponding in outer diameter to that of corresponding disc section (202,203). Central sections of the wheels above the disc portions (202,203) are formed with annular grooves (204,205) which, at the position where the wheels engage one another, define a generally circular channel to accommodate the wire (10) and the central tubular section (50) of a wire guide during a traversing operation thereof. Above the central annular sections of the wheels (200,201), the wheels are formed with sets of axially offset radial petals (206,207). Each set of petals comprises five radially projecting petals which are separated by radial recesses (208,209). Corresponding radial recesses are also formed in the annular central portions of each star wheel (200,201) in order to accommodate the loop elements (51,52) of a wire guide during a traversing operation. An annular recess (210) is formed in the annular central portion of the wheel (201) just below the radial petals (207) thereof in order to receive the radial petals (206) of the opposing wheel (200). The wheel (200) is formed with an annular stepped portion (211) just above the radial petals (206) thereof to cooperate with the petals (207) of the opposing wheel (201). In this way, the petals (206,207) of the respective wheels interleave as the wheels rotate during a traversing operation.

The wire (10) is normally disposed in a circular channel defined by recesses (204,205) at the position where the wheels (200,201) engage one another. When a wire guide is encountered, the tubular section (50) is received in the aforesaid recess, but only after a certain movement of the wheels (200,201) away from one another permitted by an axial contraction of the scissor mechanism (25). The loops (51) are received in a pair of recesses (208,209) in the wheels and illustrated in FIG. 23 whereupon the wheels rotate with respect to one another and the second set of loops (52) are then received in the following corresponding set of recesses (208,209) in the wheels. The wheels (200,201) continue to rotate with respect to one another until the wire guide has been traversed.

Advantages of the above described embodiments are that they can run along wire; they can be used on rigid track sections alone or in conjunction with wire track sections; they are self-closing under load to secure the elongate track elements in the channels defined through the attachment devices; the attachment devices can be loaded in all directions relative to the elongate element; and the attachment devices are readily removable from and engagable with the elongate element.

I claim:

1. A load attachment system comprising:

an elongate element secured with respect to a supporting structure at least at one position along its length by securing means cooperating with the elongate element and including at least a portion projecting laterally of the elongate element; and a traversing device engageable with the elongate element for movement therealong in a path which includes traversal of said projecting portion of the securing means and comprising:

(a) at least one pair of rotary members which cooperate with one another to define a channel through the traversing device for receiving and locating the elongate element;

(b) mounting means supporting the pair of rotary members for movement relative to each other to narrow the transverse width of said channel to the transverse width of said elongated element, and to increase the transverse width of said channel to accommodate therein said securing means, said mounting means being resiliently biassed in a direction to move said rotary members so as to narrow the transverse width of said channel to encompass said elongate element;

(c) load attachment means associated with said mounting means for, under loading applied thereto in directions away from the elongate element, applying a force to said pair of rotary members acting to firmly maintain them in relative positions in which said channel is narrowed to the transverse width of said elongate element thereby securing said elongate element in said channel; and (d) limiting means to restrict said movement of said pair of rollers such that said increase in the transverse width of said channel to accommodate therein said securing means is sufficient to accommodate said projecting portion of the securing means and yet does not exceed a distance that would permit detachment of the elongate member from said securing means, whereby the traversing device remains secured to the elongate member even as the traversing device traverses said securing means.

2. A system according to claim 1 wherein said limiting means are selectively releasable to allow an engagement of said traversing device with the elongate element or disengagement of said traversing device from the elongate element at an intermediate location therealong.

3. A system according to claim 1 wherein said rotary members are in the form of cooperating rollers having annular grooves in their peripheries, said channel being defined by cooperating portions of said grooves at a position where the rollers engage one another in one extreme position of their relative movement.

4. A system according to claim 3 wherein a plurality of pairs of said cooperating grooved rollers are provided on said mounting means.

5. A system according to claim 3 wherein a further grooved roller is provided on said mounting means having its axis disposed perpendicular to the axes of said cooperating rollers for running on top of said elongate element, said further roller comprising a pair of separate portions which are mounted on said mounting means to be movable away from one another when said cooperating rollers are moved relative to one another to permit the traversing device to traverse an intermediate support point of the elongate element.

6. A system according to claim 1 wherein said rotary members are in the form of wheels having radially projecting portions having arcuate grooves in their outer peripheries for defining said channel and being separated by radial recesses extend inwardly from the peripheries of the wheels for receiving and passing laterally projecting support elements for the elongate member when traversing an intermediate support point thereof.

7. A system according to claim 6 wherein a pair of spaced apart wheels are provided for location on one side of the elongate element, a further wheel being positioned between said pair of wheels, in the longitudinal direction of the elongate element, and on the opposite side of the elongate element, said mounting means being adapted to permit movement of said pair of wheels relative to said further wheel when traversing an intermediate support point of the elongate element.

8. A system according to claim 1 wherein said mounting means comprise an axially expandable and contractable link mechanism, including a pair of link arms which cross one another and are pivotally connected at their point of intersection, one pair of corresponding ends of the link arms carrying a respective one of said pair of rotary members with the other pair of corresponding ends of the link arms being pivotally connected to a load attachment structure of the device.

9. A system according to claim 1 wherein said mounting means comprise a pair of pivotally mounted supports each carrying a respective one of said pair of rotary members.

* * * * *